US010794039B2

(12) United States Patent
Wei et al.

(10) Patent No.: US 10,794,039 B2
(45) Date of Patent: Oct. 6, 2020

(54) SYSTEM AND METHOD FOR CONTROLLING THE OPERATION OF A MACHINE

(71) Applicant: Caterpillar Inc., Deerfield, IL (US)

(72) Inventors: Mo Wei, Dunlap, IL (US); Brian G. Funke, Peoria, IL (US); Paul Lenzen, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 240 days.

(21) Appl. No.: 16/058,380

(22) Filed: Aug. 8, 2018

(65) Prior Publication Data

US 2020/0048862 A1 Feb. 13, 2020

(51) Int. Cl.

| | |
|---|---|
| ***E02F 3/84*** | (2006.01) |
| ***E02F 3/76*** | (2006.01) |
| ***E02F 9/26*** | (2006.01) |

(52) U.S. Cl.

CPC ..... *E02F 3/841* (2013.01); *E02F 3/7618* (2013.01); *E02F 9/261* (2013.01)

(58) Field of Classification Search

CPC ..... E02F 3/7618; E02F 3/841; E02F 9/261; E02F 9/2045; E02F 9/2029; E02F 3/844; G05D 2201/021

See application file for complete search history.

(56) References Cited

U.S. PATENT DOCUMENTS

| | | | | |
|---|---|---|---|---|
| 5,864,970 | A * | 2/1999 | Maddock | E02F 3/188 37/908 |
| 5,984,018 | A * | 11/1999 | Yamamoto | E02F 3/844 172/2 |
| 6,167,336 | A * | 12/2000 | Singh | E02F 3/434 172/2 |
| 6,181,999 | B1 * | 1/2001 | Yamamoto | E02F 3/844 172/4.5 |
| 7,676,967 | B2 * | 3/2010 | Gharsalli | E02F 3/844 37/348 |
| 8,548,691 | B2 * | 10/2013 | Hayashi | E02F 9/2029 172/4.5 |
| 9,097,520 | B2 * | 8/2015 | Stratton | G01C 7/04 |
| 9,469,967 | B2 | 10/2016 | Edara et al. | |
| 9,523,183 | B2 | 12/2016 | Wei et al. | |
| 2002/0162668 | A1 * | 11/2002 | Carlson | E02F 3/847 172/4.5 |

(Continued)

*Primary Examiner* — Mussa A Shaawat
(74) *Attorney, Agent, or Firm* — Leydig, Voit & Mayer, Ltd.

(57) ABSTRACT

A system for automated control of a machine along a first slot in a work surface includes a machine position sensor and a controller. The controller is configured to determine an elevation difference between each pair of laterally aligned positions of the first slot and a second adjacent slot, generate a first propulsion command to operate the machine according to a first propulsion mode while the machine is disposed along the first slot adjacent each pair of laterally aligned positions at which the elevation difference is less than a slot elevation difference threshold, and generate a second propulsion command to operate the machine according to a second propulsion mode while the machine is disposed along the first slot adjacent each pair of laterally aligned positions at which the elevation difference is greater than the slot elevation difference threshold.

20 Claims, 6 Drawing Sheets

(56) References Cited

U.S. PATENT DOCUMENTS

2004/0168358 A1* 9/2004 Stump ..... G01S 19/41 37/348
2007/0044980 A1* 3/2007 Stratton ..... E02F 3/844 172/4.5
2007/0129869 A1* 6/2007 Gudat ..... G05D 1/0297 701/50
2008/0180523 A1* 7/2008 Stratton ..... G09B 9/048 348/114
2009/0043462 A1* 2/2009 Stratton ..... E02F 9/2033 701/50
2009/0202109 A1* 8/2009 Clar ..... G06T 17/05 382/104
2010/0010703 A1* 1/2010 Coats ..... G05D 1/0278 701/29.6
2010/0250023 A1* 9/2010 Gudat ..... G05D 1/0022 701/2
2010/0299031 A1* 11/2010 Zhdanov ..... E02F 3/845 701/50
2011/0093171 A1* 4/2011 Saposnik ..... G05B 9/02 701/50
2012/0089293 A1* 4/2012 Halder ..... B60W 50/0205 701/24
2012/0136508 A1* 5/2012 Taylor ..... G05D 1/0274 701/2
2012/0139325 A1* 6/2012 Norberg ..... G01C 15/00 299/10
2012/0215378 A1* 8/2012 Sprock ..... G07C 5/008 701/2
2012/0271504 A1* 10/2012 Reiners ..... E02F 9/261 701/29.1
2014/0012404 A1* 1/2014 Taylor ..... G06F 30/13 700/97
2014/0032030 A1* 1/2014 Stratton ..... E02F 3/841 701/23
2014/0032058 A1* 1/2014 Stratton ..... E02F 9/2045 701/50
2014/0032132 A1* 1/2014 Stratton ..... E02F 9/2029 702/33
2014/0180444 A1* 6/2014 Edara ..... E02F 3/841 700/56
2014/0180547 A1* 6/2014 Edara ..... E02F 9/205 701/50
2016/0076223 A1* 3/2016 Wei ..... E02F 9/265 701/50
2016/0076224 A1* 3/2016 Edara ..... E02F 9/2041 701/50
2016/0343095 A1* 11/2016 Wei ..... G06Q 10/06398
2018/0038082 A1 2/2018 Hashimoto et al.

* cited by examiner

SYSTEM AND METHOD FOR CONTROLLING THE OPERATION OF A MACHINE

TECHNICAL FIELD

This disclosure relates generally to controlling a machine and, more particularly, to a system and method for analyzing elevation differences between adjacent slots in a work surface and providing the elevation differences exceeding one or more thresholds.

BACKGROUND

Machines such as dozers, motor graders, wheel loaders, etc., are used to perform a variety of tasks. For example, these machines may be used to move material at a work site. The machines may operate in an autonomous, semi-autonomous, or manual manner to perform these tasks in response to commands generated as part of a work plan for the machines. The machines may receive instructions in accordance with the work plan to perform operations including digging, loosening, carrying, etc., different materials at the work site such as those related to mining, earthmoving and other industrial activities.

Autonomously operated machines may remain consistently productive without regard to a human operator or environmental conditions. In addition, autonomous systems may permit operation in environments that are unsuitable or undesirable for a human operator. Autonomous or semi-autonomous systems may also compensate for inexperienced human operators as well as inefficiencies associated with repetitive tasks.

When performing slot dozing operations, adjacent slots may have lower surfaces at substantially different heights. Accordingly, if a machine does not accurately follow the path of its slot and begins to enter an adjacent slot, the machine may pass through the berm between slots and tip over or contact the berm and become buried in material. The risk of either scenario increases when the machine is operating in an autonomous or semi-autonomous manner.

U.S. Pat. No. 9,469,967 discloses a system for automated control of a machine in conjunction with a slot dozing process. The system analyzes the physical characteristics of a pair of adjacent slots to determine whether certain thresholds are exceeded. Upon exceeding one or more of the thresholds, a berm reduction command is generated to direct a machine to reform or remove the berm between two slots The foregoing background discussion is intended solely to aid the reader. It is not intended to limit the innovations described herein, nor to limit or expand the prior art discussed. Thus, the foregoing discussion should not be taken to indicate that any particular element of a prior system is unsuitable for use with the innovations described herein, nor is it intended to indicate that any element is essential in implementing the innovations described herein. The implementations and application of the innovations described herein are defined by the appended claims.

SUMMARY

In one aspect, a system for automated control of a machine along a first slot in a work surface includes a machine position sensor and a controller. The first slot is adjacent to a second slot in the work surface and has a berm disposed between the first slot and the second slot. The machine position sensor is configured to generate a plurality of machine position signals indicative of a position of the machine at a work site. The controller is configured to store a slot elevation difference threshold, receive a plurality of machine position signals from the machine position sensor, determine the position of the machine along the first slot based upon the plurality of machine position signals, and access a plurality of first positions of at least one first slot surface spaced apart along the first slot. The controller is further configured to access a plurality of second positions of at least one second slot surface along the second slot, with each of the plurality of first positions being laterally aligned with one of the plurality of second positions to define pairs of laterally aligned positions, determine an elevation difference between each pair of laterally aligned positions, generate a first propulsion command to operate the machine according to a first propulsion mode while the machine is disposed along the first slot adjacent each pair of laterally aligned positions at which the elevation difference is less than the slot elevation difference threshold, and generate a second propulsion command to operate the machine according to a second propulsion mode while the machine is disposed along the first slot adjacent each pair of laterally aligned positions at which the elevation difference is greater than the slot elevation difference threshold.

In another aspect, a controller-implemented method is provided for automated control of a machine along a first slot in a work surface where the first slot is adjacent to a second slot in the work surface with a berm disposed between the first slot and the second slot. The method includes storing a slot elevation difference threshold, receiving a plurality of machine position signals from a machine position sensor, determining a position of the machine along the first slot based upon the plurality of machine position signals, and accessing a plurality of first positions of at least one first slot surface spaced apart along the first slot. The method further includes accessing a plurality of second positions of at least one second slot surface along the second slot, with each of the plurality of first positions being laterally aligned with one of the plurality of second positions to define pairs of laterally aligned positions, determining an elevation difference between each pair of laterally aligned positions, generating a first propulsion command to operate the machine according to a first propulsion mode while the machine is disposed along the first slot adjacent each pair of laterally aligned positions at which the elevation difference is less than the slot elevation difference threshold, and generating a second propulsion command to operate the machine according to a second propulsion mode while the machine is disposed along the first slot adjacent each pair of laterally aligned positions at which the elevation difference is greater than the slot elevation difference threshold.

In still another aspect a machine includes a prime mover, a ground-engaging work implement for engaging a work surface along a path, a machine position sensor for generating a plurality of machine position signals indicative of a position of the machine at a work site and a controller. The controller is configured to store a slot elevation difference threshold, receive a plurality of machine position signals from the machine position sensor, determine the position of the machine along a first slot in a work surface based upon the plurality of machine position signals, access a plurality of first positions of at least one first slot surface spaced apart along the first slot. The controller is further configured to access a plurality of second positions of at least one second slot surface along a second slot in the work surface, with the first slot being adjacent to the second slot with a berm disposed between the first slot and the second slot and each of the plurality of first positions being laterally aligned with one of the plurality of second positions to define pairs of laterally aligned positions, determine an elevation difference between each pair of laterally aligned positions, generate a first propulsion command to operate the machine according to a first propulsion mode while the machine is disposed along the first slot adjacent each pair of laterally aligned positions at which the elevation difference is less than the slot elevation difference threshold, and generate a second propulsion command to operate the machine according to a second propulsion mode while the machine is disposed along the first slot adjacent each pair of laterally aligned positions at which the elevation difference is greater than the slot elevation difference threshold.

DETAILED DESCRIPTION

Figure 1:
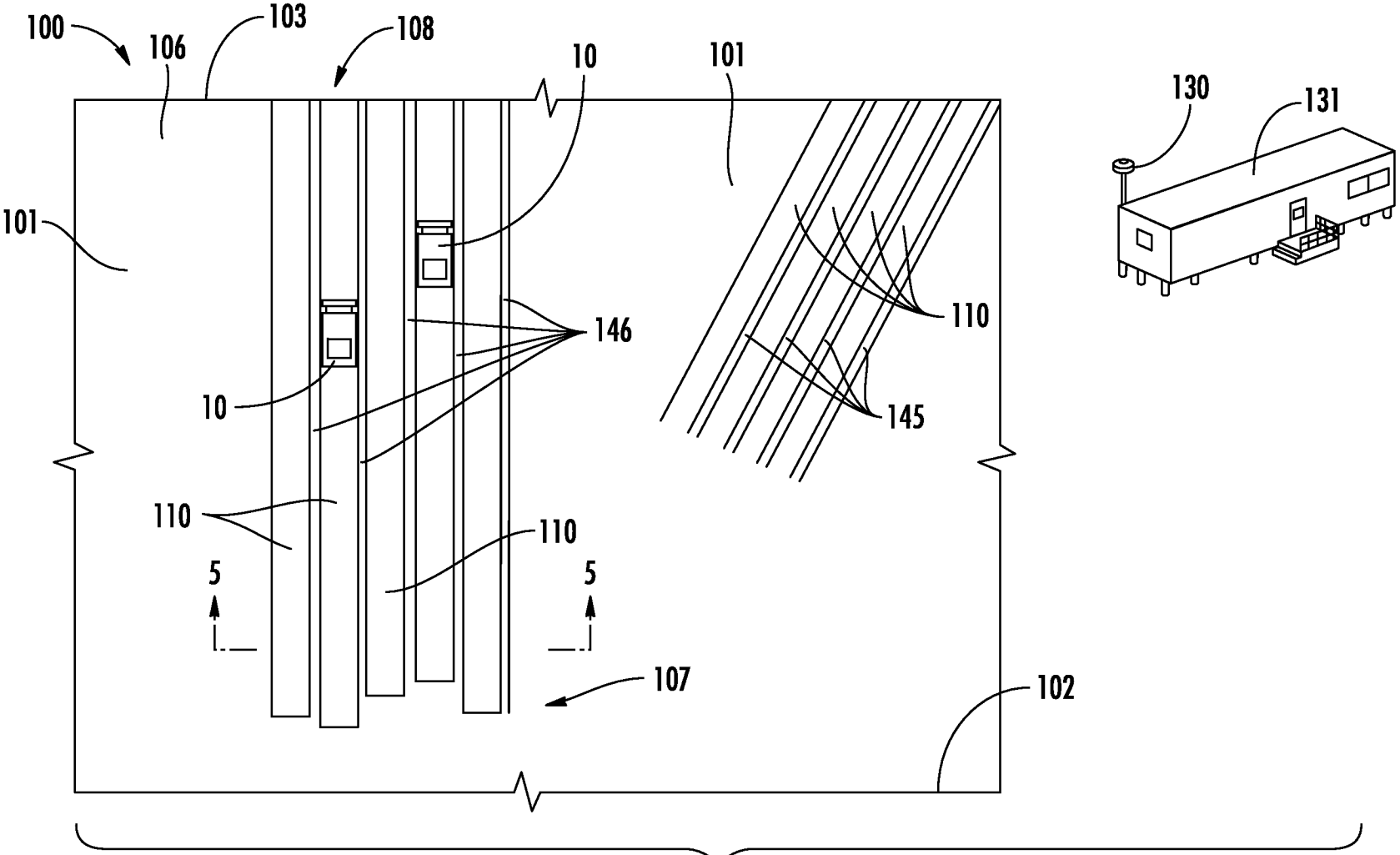
FIG. 1 depicts a schematic view of a work site at which a machine incorporating the principles disclosed herein may be used.

FIG. 1 depicts a diagrammatic illustration of a work site 100 at which one or more machines 10 may operate in an autonomous, a semi-autonomous, or a manual manner. Work site 100 may be a portion of a mining site, a landfill, a quarry, a construction site, or any other area in which movement of material is desired. Tasks associated with moving material may include a dozing operation, a grading operation, a leveling operation, a bulk material removal operation, or any other type of operation that results in the alteration of the existing topography at work site 100. As depicted, work site 100 includes a first work area 101 having a high wall 102 at one end and a crest 103 such as an edge of a ridge, embankment, or other change in elevation at an opposite end. Material is moved generally from the high wall 102 towards the crest 103. The work surface 104 of the work area 101 may take any form and refers to the actual profile or position of the terrain of the work area. A second work area 101 is depicted at an angle to the first work area.

As used herein, a machine 10 operating in an autonomous manner operates automatically based upon information received from various sensors without the need for human operator input. As an example, a haul or load truck that automatically follows a path from one location to another and dumps a load at an end point may be operating autonomously. A machine operating semi-autonomously includes an operator, either within the machine or remotely, who performs some tasks or provides some input and other tasks are performed automatically and may be based upon information received from various sensors. As an example, a load truck that automatically follows a path from one location to another but relies upon an operator command to dump a load may be operating semi-autonomously. In another example of a semi-autonomous operation, an operator may dump a bucket of an excavator in a load truck and a controller may automatically return the bucket to a position to perform another digging operation. A machine being operated manually is one in which an operator is controlling all or essentially all of the functions of the machine. A machine may be operated remotely by an operator (i.e., remote control) in either a manual or semi-autonomous manner. In some operations, a plurality of machines 10 may be configured to be operated autonomously or semi-autonomously and one or more operators responsible for overseeing the operation of the machines. At times, an operator may manually take over responsibility for the operation of one or more of the machines.

Figure 2:
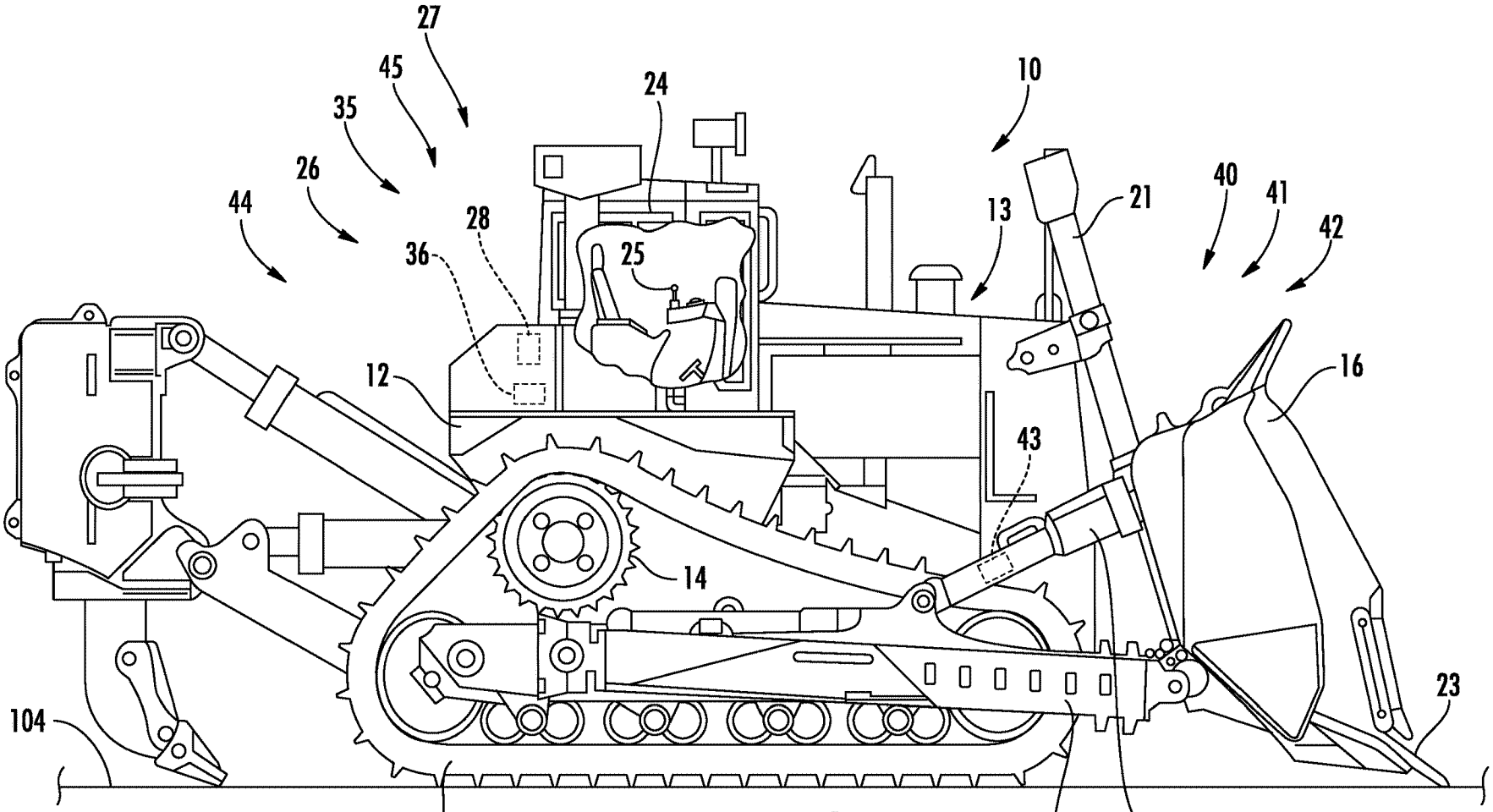
FIG. 2 depicts a diagrammatic illustration of a machine in accordance with the disclosure.

FIG. 2 depicts a diagrammatic illustration of a machine 10 such as a dozer with a ground-engaging work implement such as a blade 16 configured to push material. The machine 10 includes a frame 12 and a prime mover such as an engine 13. A ground-engaging drive mechanism such as a track 15 may be driven by a drive sprocket 14 on opposite sides of machine 10 to propel the machine. Although machine 10 is shown in a "track-type" configuration, other configurations, such as a wheeled configuration, may be used. Operation of the engine 13 and a transmission (not shown), which are operatively connected to the drive sprockets 14 and tracks 15, may be controlled by a control system 35 including a controller 36. The systems and methods of the disclosure may be used with any machine propulsion and drivetrain mechanisms applicable in the art for causing movement of the machine including hydrostatic, electric, or mechanical drives.

Blade 16 may be pivotally connected to frame 12 by arms 18 on each side of machine 10. First hydraulic cylinder 21 coupled to frame 12 supports blade 16 in the vertical direction and allows blade 16 to move up or down vertically from the point of view of FIG. 2. Second hydraulic cylinders 22 on each side of machine 10 allow the pitch angle of blade tip 23 to change relative to a centerline of the machine.

Machine 10 may include a cab 24 that an operator may physically occupy and provide input to control the machine. Cab 24 may include one or more input devices such as joystick 25 through which the operator may issue commands to control the propulsion system and steering system of the machine as well as operate various implements associated with the machine.

Machine 10 may be controlled by a control system 35 as shown generally by an arrow in FIG. 2 indicating association with the machine 10. The control system 35 may include an electronic control module or controller 36 and a plurality of sensors. The controller 36 may receive input signals from an operator operating the machine 10 from within cab 24 or off-board the machine through a wireless communications system 130 (FIG. 1). The controller 36 may control the operation of various aspects of the machine 10 including the drivetrain and the hydraulic systems.

The controller 36 may be an electronic controller that operates in a logical fashion to perform operations, execute control algorithms, store and retrieve data and other desired operations. The controller 36 may include or access memory, secondary storage devices, processors, and any other components for running an application. The memory and secondary storage devices may be in the form of read-only memory (ROM) or random access memory (RAM) or integrated circuitry that is accessible by the controller. Various other circuits may be associated with the controller 36 such as power supply circuitry, signal conditioning circuitry, driver circuitry, and other types of circuitry.

The controller 36 may be a single controller or may include more than one controller disposed to control various functions and/or features of the machine 10. The term "controller" is meant to be used in its broadest sense to include one or more controllers and/or microprocessors that may be associated with the machine 10 and that may cooperate in controlling various functions and operations of the machine. The functionality of the controller 36 may be implemented in hardware and/or software without regard to the functionality. The controller 36 may rely on one or more data maps relating to the operating conditions and the operating environment of the machine 10 and the work site 100 that may be stored in the memory of controller. Each of these data maps may include a collection of data in the form of tables, graphs, and/or equations.

The control system 35 and the controller 36 may be located on the machine 10 and may also include components located remotely from the machine such as at a command center 131 (FIG. 1). The functionality of control system 35 may be distributed so that certain functions are performed at machine 10 and other functions are performed remotely. In such case, the control system 35 may include a communications system such as wireless communications system 130 for transmitting signals between the machine 10 and a system located remote from the machine.

Machine 10 may be configured to be operated autonomously, semi-autonomously, or manually. When operating semi-autonomously or manually, the machine 10 may be operated by remote control and/or by an operator physically located within the cab 24.

Machine 10 may be equipped with a plurality of machine sensors 26, as shown generally by an arrow in FIG. 2 indicating association with the machine 10, that provide data indicative (directly or indirectly) of various operating parameters of the machine and/or the operating environment in which the machine is operating. The term "sensor" is meant to be used in its broadest sense to include one or more sensors and related components that may be associated with the machine 10 and that may cooperate to sense various functions, operations, and operating characteristics of the machine and/or aspects of the environment in which the machine is operating.

A machine position sensing system 27, as shown generally by an arrow in FIG. 2 indicating association with the machine 10, may include a machine position sensor 28, also shown generally by an arrow in FIG. 2 to indicate association with the machine, to sense the position and orientation (i.e., the heading, pitch, roll or tilt, and yaw) of the machine relative to the work site 100. The position and orientation of the machine 10 are sometimes collectively referred to as the position of the machine. The machine position sensor 28 may include a plurality of individual sensors that cooperate to generate and provide a plurality of machine position signals to controller 36 indicative of the position and orientation of the machine 10. In one example, the machine position sensor 28 may include one or more sensors that interact with a positioning system such as a global navigation satellite system or a global positioning system to operate as a position sensor. In another example, the machine position sensor 28 may further include a slope or inclination sensor such as pitch angle sensor for measuring the slope or inclination of the machine 10 relative to a ground or earth reference. The controller 36 may use machine position signals from the machine position sensors 28 to determine the position of the machine 10 within work site 100. In other examples, the machine position sensor 28 may include an odometer or another wheel rotation sensing sensor, a perception based system, or may use other systems such as lasers, sonar, or radar to determine all or some aspects of the position of machine 10.

In some embodiments, the machine position sensing system 27 may include a separate orientation sensing system. In other words, a position sensing system may be provided for determining the position of the machine 10 and a separate orientation sensing system may be provided for determining the orientation of the machine.

If desired, the machine position sensing system 27 may also be used to determine a ground speed of machine 10. Other sensors or a dedicated ground speed sensor may alternatively be used to determine the ground speed of the machine 10.

In addition, the machine position sensing system 27 may also be used to determine the elevation of the work surface upon which the machine 10 is moving. More specifically, based upon known dimensions of the machine 10 and the elevation of the machine at the work site 100, the elevation of the work surface may also be determined. As a result, the machine position sensing system 27 may operate as either or both of a machine position sensing system and a work surface elevation sensing system. Similarly, the machine position sensor 28 may operate as either or both of a machine position sensor and a work surface elevation sensor. When operating as an elevation sensor, the machine position sensor 28 may generate elevation signals that are interpreted by the controller 36 to determine the relevant elevation Other sensors or a dedicated work surface position sensor may alternatively be used to determine the elevation of the work surface.

Machine 10 may be configured to move material at the work site 100 according to one or more material movement plans from a first location 107 to a second spread or dump location 108, typically located downhill from the first location. The dump location 108 may be at crest 103 or at any other location. The material movement plans may include, among other things, forming a plurality of spaced apart channels or slots 110 that are cut into the work surface 104 at work site 100 along a path from the first location 107 to the dump location 108. In doing so, each machine 10 may move back and forth along a path 117 (FIG. 3) between the first location 107 and the dump location 108. If desired, a relatively small amount of material may be left or built up as walls or berms 146 between adjacent slots 110 to prevent or reduce spillage and increase the efficiency of the material moving process. The process of moving material through slots 110 while utilizing berms 146 of material to increase the efficiency of the process is sometimes referred to as "slot dozing."

Figure 3:
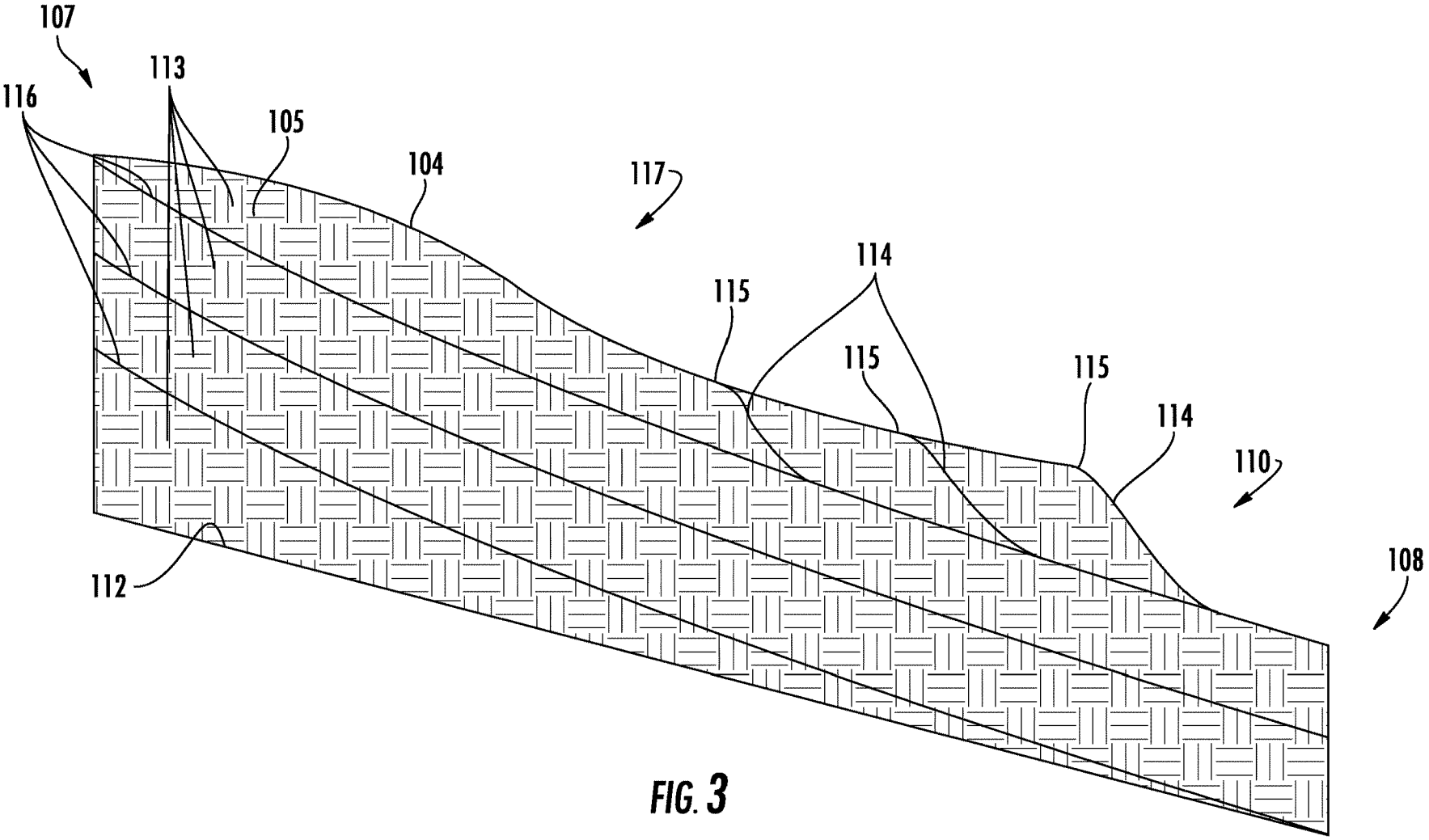
FIG. 3 depicts a cross-section of a portion of a work site depicting various aspects of a material moving plan.

As depicted in FIG. 3, in one embodiment, each slot 110 may be formed by removing material 105 from the work surface 104 in one or more layers 113 until the final work surface or final design plane 112 is reached. The blade 16 of machine 10 may engage the work surface 104 with a series of cuts 114 that are spaced apart lengthwise along the slot 110. Each cut 114 begins at a cut location 115 along the work surface 104 at which the blade 16 engages the work surface and extends into the material 105 and moves towards the target surface 116 for a particular layer. As used herein, the work surface 104 along a slot prior to beginning to move material along that layer 113 is referred to as the initial surface. The target or desired position or elevation down to which material is to be cut for each layer 113 is referred to as the target surface. In many operations, the cut location 115 begin at a location closest to the dump location 108 and are moved progressively back or uphill towards the first location 107. Thus, as depicted in FIG. 3, material is moved by performing a plurality of cut operations at sequential cut locations 115 from right to left.

In one embodiment, the depth of each layer 113 (i.e., distance between the initial surface and the target surface 116) may be approximately 1 m. In such embodiment, approximately 20-50 sequential cutting operations may be performed along the initial surface to move all of the material from that layer 113 to fully expose the target surface 116. In operation, the machine 10 begins performing a series of cutting or material moving operations at the first cut location along the initial surface. Material movement operations continue sequentially (from right to left in FIG. 3) at the cut locations until all of the material has been removed from the layer 113 so that the target surface is exposed. The next series of material moving operations may then begin within the slot 110 with the previous target surface operating as the initial surface for the next series of material moving or cutting operations and the new target surface is set by the planning system 45 of the control system 35.

Figure 4:
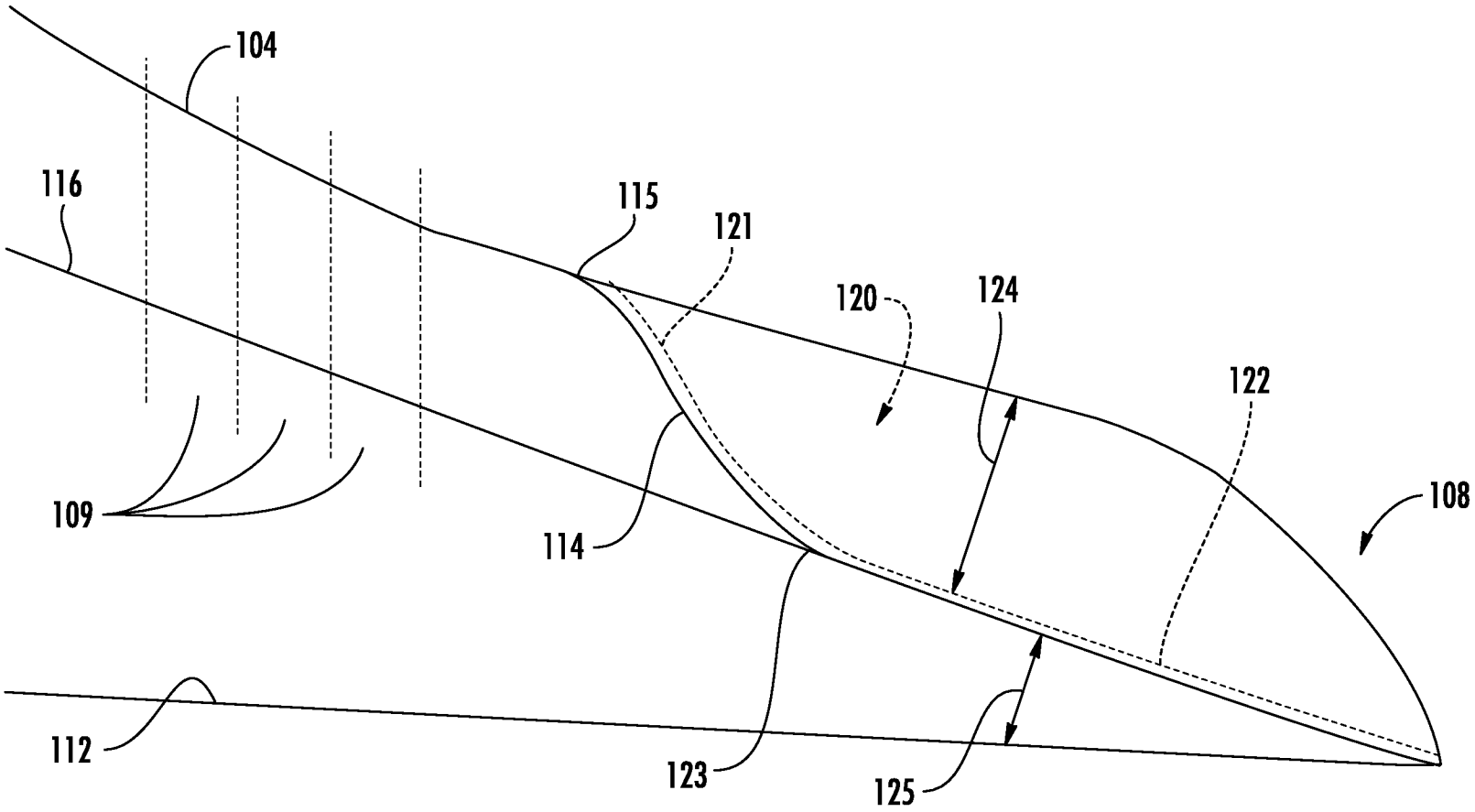
FIG. 4 depicts a diagrammatic cross-section of a portion of a work site depicting a potential target profile.

Controller 36 may be configured to guide the blade 16 along each cut 114 beginning at the initial surface and continuing until reaching the target surface 116 and then follow the target surface towards the dump location 108. Referring to FIG. 4, during each material moving pass, the controller 36 may guide the blade 16 generally along a desired path or target profile depicted by dashed line 120 from the cut location 115 to the dump location 108. A first portion of the target profile 120 extends from the cut location 115 to the target surface 116. The first portion may be referred to as the loading profile 121 as that is the portion of the target profile 120 at which the blade 16 is initially loaded with material. A second portion of the target profile 120 extends from the intersection 123 of the cut 114 and the target surface 116 to the dump location 108. The second portion may be referred to as the carry profile 122 as that is the portion of the target profile 120 at which the blade 16 carries the load along the target surface 116.

The first portion or loading profile 121 may have any configuration and, depending on various factors including the configuration of the work surface 104 and the type of material to be moved, some cut profiles may be more efficient than others. The loading profile 121 may be formed of one or more segments that are equal or unequal in length and with each having different or identical shapes. These shapes may be linear, symmetrically or asymmetrically curved, Gaussian-shaped or any other desired shape. In addition, the angle of any of the shapes relative to the work surface 104 or the final design plane 112 may change from segment to segment.

The second portion or carry profile 122 may have any configuration but is often generally linear and sloped downward so that movement of material will be assisted by gravity to increase the efficiency of the material moving process. In other words, the carry profile 122 is often configured so that it slopes downward towards the dump location 108. The characteristics of the carry profile 122 (sometimes referred to as the slot parameters) may define the shape of the target surface 116, the depth of the target surface below the current uppermost or initial surface of the work surface 104 as indicated by reference number 124, and the angle of the target surface as indicated by reference number 125. In some instances, the angle 125 of the carry surface 116 may be defined relative to a gravity reference or relative to the final design plane 112.

As used herein, the word "uphill" refers to a direction towards the high wall 102 relative to the crest 103 or dump location 108. Similarly, the word "downhill" refers to a direction towards the crest 103 or dump location 108 relative to the high wall 102.

Control system 35 may include a module or planning system 45 for determining or planning various aspects of the excavation plan. The planning system 45 may receive and store various types of input such as the configuration of the work surface 104, the final design plane 112, a desired loading profile 121, a desired carry profile 122, and characteristics of the material to be moved. Operating characteristics and capabilities of the machine 10 such as maximum load may also be entered into the planning system 45. The planning system 45 may simulate the results of cutting the work surface 104 at a particular cut location and for a particular target profile, and then choose a cut location that creates the most desirable results based on one or more criteria.

In one embodiment, the planning function may be performed while operating the machine 10. In another embodiment, some or all aspects of the planning function may be performed ahead of time and the various inputs to the planning system 45 and the resultant cut locations, target profiles, and related data stored as part of the data maps of the controller 36.

During the planning process, the planning system 45 may divide the path 117 along each slot 110 into a plurality of increments 109 (FIG. 4) and data stored within controller 36 for each increment. The controller 36 may store information or characteristics of each increment 109 such as its position along the path, its elevation relative to a reference such as sea level, its angular orientation relative to a ground reference, and any other desired information. The information regarding each path 117 may be stored within an electronic map within the controller 36 as part of a topographical map of the work site 100. By dividing the path 117 into a plurality of increments 109, the analysis and planning process may be simplified by analyzing the characteristics at each increment.

Information regarding each path 117 may be obtained according to any desired method. In one example, the machine 10 may utilize the machine position sensing system 27 described above to map out the contour of work surface 104 as machine 10 moves across it. This data may also be obtained according to other methods such as by a vehicle that includes lasers and/or cameras. It should be noted that as the machine 10 moves material 105 to the dump location 108, the position or contour of the work surface 104 will change and may be updated based upon the current position of the machine 10 and the position of the blade 16.

Figure 5:
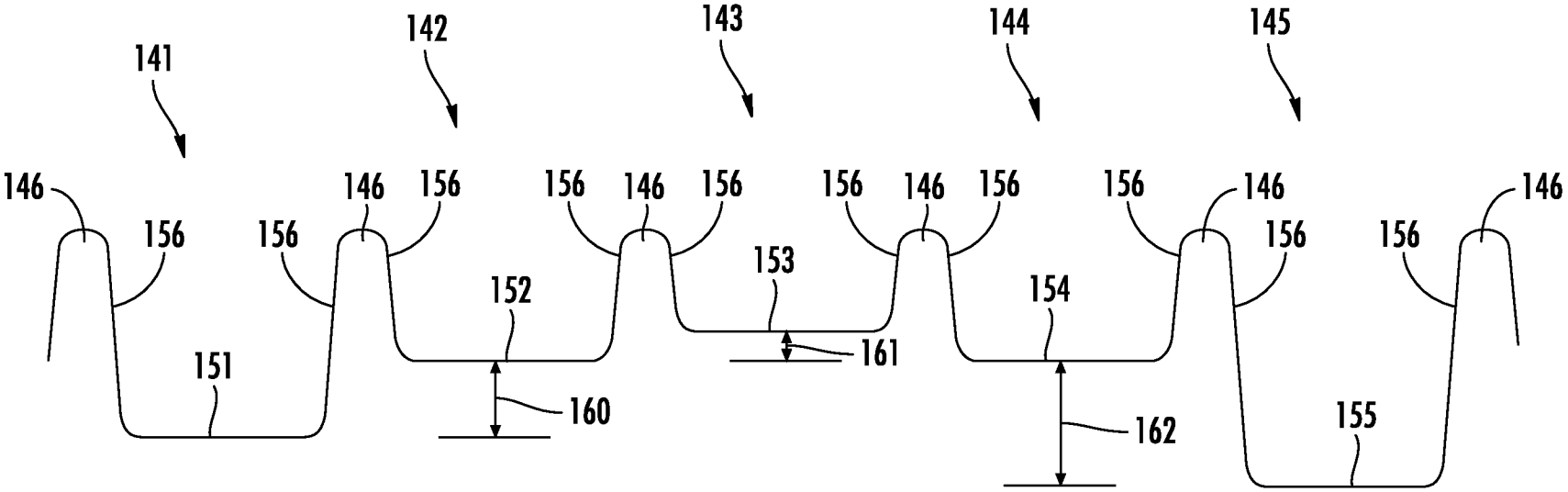
FIG. 5 depicts a cross-section of a series of slots of FIG. 1 taken generally along line 5-5.

Referring to FIG. 5, when performing slot dozing operations, a plurality of slots 141-145 may be formed with material left between each adjacent pair of slots in the form of a berm 146. The berm 146 assists in the slot dozing process by limiting the amount of material 105 that can move sideways or laterally relative to the blade 16 as the machine 10 pushes the material down each path 117 to form a slot.

Before the slot dozing operation is begun, the work surface 104 may have a generally uniform original elevation or original work surface depicted by the dashed line 106. During a slot dozing process, most of the material 105 being cut or moved by the blade 16 of machine 10 as it moves down the path 117 will be moved through the slots 141-145 along their respective lower surfaces 151-155 to the dump location 108 and will be guided by the boundary formed by the sidewalls 156 of each slot.

During an autonomous or semi-autonomous material moving operation, a plurality of machines 10 may be moved along the work surface 104 while performing slot dozing operations. Although FIG. 5 depicts five parallel slots 110, the material moving operation may be performed with any desired number of slots. In some instances, the excavation of adjacent slots may not occur at the same rate. In such case, a difference in height or elevation between the lower surfaces of adjacent slots may exist. For example, the difference in elevation between the lower surface 151 of the first slot 141 and the lower surface 152 of the second slot 142 is depicted at 160. The difference in elevation between the lower surface 152 of the second slot 142 and the lower surface 153 of the third slot 143 is depicted at 161. The difference in elevation between the lower surface 153 of the third slot 153 and the lower surface 154 of the fourth slot 144 is identical to the difference 161. The difference in elevation between the lower surface 154 of the fourth slot 144 and the lower surface 155 of the fifth slot 145 is depicted at 162.

When moving the machines 10 along a slot 110 autonomously, the machine may deviate from traveling along the centerline of the path. As the difference in height between adjacent slots increases, risks associated with such deviation may increase. For example, it is typically desirable to move the machines 10 in reverse in second gear in order to minimize fuel usage and the amount of time spent backing up the machine to the next cut location 115. However, if a machine 10 is moving relatively rapidly in second gear and an adjacent slot has a lower surface that is at a substantially different elevation from the slot in which the machine is positioned, deviation of the machine from the centerline of its slot may result in the machine contacting the berm 146.

In many instances, the berm 146 may not be substantial enough to redirect the machine 10 back to the centerline of its slot. If the lower surface of the adjacent slot is below the lower surface of the slot in which the machine 10 is located, the machine may enter the adjacent slot. Further, if the lower surface of the adjacent slot is substantially below that of the current slot of the machine 10, the machine may tip over. If the lower surface of the adjacent slot is sufficiently substantially above the lower surface of the current slot of the machine, the sidewall 156 and berm 146 may collapse onto the machine. In one example, if the material from the sidewall 156 and berm 146 collapse sufficiently high onto the tracks 15 of the machine, the machine may become stuck. In another example, if the material from the sidewall 156 and the berm 146 collapse onto the machine 10 and bury the engine 13 or components thereof, in addition to the risk of the machine becoming stuck, a risk also exists that damage may occur to the engine.

The control system 35 may thus include a planning system 45 that operates to evaluate the slots 110 and control the operation of the machines within the slots when the height differences between the slots exceed certain thresholds. More specifically, the planning system 45 may store or access one or more slot elevation difference thresholds and control or restrict the propulsion of the machine 10 when the slot elevation difference thresholds are exceeded. As an example, a first slot elevation difference threshold stored or accessed by the controller may be equal to one half of the height of the machine 10 and a second slot elevation difference threshold may be equal to the height of the machine.

During operation, the controller 36 may compare the height or elevation of the lower surface along a first slot at a plurality of positions or increments 109 to the height or elevation of the lower surface along an adjacent second slot at a plurality of laterally aligned positions or increments along an adjacent second slot to determine an elevation difference for each pair of laterally aligned positions. If neither slot elevation difference threshold is exceeded for any of the laterally aligned positions, the controller 36 may operate according to a first propulsion mode such as by generating propulsion commands to operate the machine 10 in second gear while in reverse. An example of an elevation difference that does not exceed either the first or second slot elevation thresholds is depicted at 161 in FIG. 5.

However, if the elevation difference exceeds the first slot elevation difference threshold but not the second slot elevation difference threshold at some of the laterally aligned positions, the controller 36 may operate according to a second propulsion mode such as by generating propulsion commands to operate the machine 10 in first gear in reverse while adjacent each pair of laterally aligned positions at which the elevation difference is greater than the first slot elevation difference threshold but less than the second slot elevation difference threshold. An example of an elevation difference that exceeds the first slot elevation threshold but not the second slot elevation threshold is depicted at 160 in FIG. 5.

If the elevation difference is greater than both the first slot elevation difference threshold and the second slot elevation difference threshold at some of the laterally aligned positions, the controller 36 may operate according to a third propulsion mode such as by requiring that the machine be operated in a manual mode while in reverse gear and adjacent each pair of laterally aligned positions at which the elevation difference is greater than both the first slot elevation difference threshold and the second slot elevation difference threshold. An example of an elevation difference that exceeds both the first slot elevation threshold and the second slot elevation threshold is depicted at 163 in FIG. 5.

Thus, when the elevation difference is less than the second slot elevation difference threshold, the controller 36 may control the operation of the machine 10 so that the transmission shifts between first and second gears as desired while the machine moves along the slot 110. In one embodiment, the controller 36 may shift from second gear to first gear prior to or at each instance in which the elevation difference exceeds the first slot elevation difference threshold but is less than the second slot elevation difference threshold and then shifts back to second gear after passing the position at which the first slot elevation difference threshold is exceeded.

In other embodiments, the controller 36 may maintain the transmission in first gear even after the elevation difference is less than the first slot elevation difference threshold. Operating the machine 10 in first gear, even though the elevation difference is less than the first slot elevation difference threshold, may be desirable to reduce the number of shifting operations as the machine moves along the slot 110. Such operation may be desirable to reduce wear on the transmission.

Although described above in the context of comparing the elevation of the lower surface of the first slot to the elevation of the lower surface of a second slot, it will be understood that, in most instances, each slot will have an adjacent slot on each side thereof. As a result, the above-described comparison may be performed by comparing each slot to each of the slots on opposite sides thereof. The machine 10 may then be operated in the most conservative manner relative to each pair of laterally aligned positions. In other words, for any increment 109 along a slot 110, if an analysis with respect to the first adjacent slot would require the machine to be operating in first gear and an analysis with respect to the second adjacent slot would require the machine to be operating manually, the controller 36 may be configured to require the machine to be operated manually. Similarly, if an analysis with respect to an increment 109 of the first adjacent slot would require the machine to be operating in first gear and analysis with respect to the second adjacent slot would permit the machine to be operating in second gear, the controller may be configured to require the machine to be operated in first gear.

In some instances, the exact elevation of the lower surface of each slot may not be immediately known by the controller 36. For example, if the planning system 45 is operating or disposed at a location remote from the machines 10, data with respect to the elevation of the lower surface of each slot may not always be up-to-date, such as due to communications issues (e.g., only periodic reporting or connection issues). Similarly, if the planning system 45 is operating or disposed on each machine 10, data with respect to the lower surface of adjacent slots may not always be up to date on the machine due to similar communications issues.

However, since the material moving process involves setting a target surface 116 below the initial surface and then performing a series of lateral sequential cuts between the initial surface and the target surface, the highest actual elevation of any portion of the work surface corresponds to the elevation of the initial surface and the lowest elevation of any portion the work surface corresponds to the elevation of the target surface. As a result, in order to reduce risks associated with poor or intermittent communications, the planning system 45 may be configured to determine the maximum possible difference between the surfaces of adjacent slots at each pair of aligned increments 109. To do so, the planning system 45 may compare the initial surface of a slot to both the initial and the target surfaces of each adjacent slot at each pair of aligned positions along the slots. In addition, the planning system 45 may also compare the target surface of the slot to both the initial and target surfaces of each adjacent slot at each pair of aligned positions along the slots.

Thus, the planning system 45 may be configured to compare the slot surfaces along the slot in which the machine is disposed to the slot surfaces along each adjacent slot. More specifically, in some embodiments, the planning system 45 may be configured to compare the actual surface along the slot in which the machine is disposed to either the actual surface of each adjacent slot or to the initial surface and the target surface of each adjacent slot since the elevation of the actual surface will be between the initial surface and the target surface. Still further, in other embodiments, the planning system 45 may be configured to compare the initial surface and the target surface along the slot in which the machine is disposed to either the actual surface of each adjacent slot or to both the initial surface and the target surface of each adjacent slot since the elevation of the actual surface will be between the initial surface and the target surface. The planning system 45 may then control the propulsion of the machine 10 based upon the greatest elevation difference between any of the surfaces being compared as described above.

In some instances, such as when a slot is at the end of a work area, the slot may not include another slot on both or opposite sides thereof. In such case, after a number of layers 113 of material have been removed, the difference in elevation between the end slot and the material next to it will exceed either or both of the first slot elevation difference threshold and the second slot elevation difference threshold. In such case, if the elevation of the material next to the end slot is known, the planning system 45 may be configured to operate in the manner described above with respect to slots that include slots on both sides thereof. However, if the elevation of the material next to the end slot is not known, the planning system 45 may be configured to default to the operation in which either the first slot elevation difference threshold (e.g., operate in first gear) or the second slot elevation difference threshold is exceeded (e.g., operate manually). The planning system 45 may operate in a similar manner when one slot extends beyond the adjacent slots and the elevation of the work surface 104 adjacent the extension of the slot is not known.

Although the machine 10 is described in the context of shifting between first and second gears, the disclosure is applicable to reductions in speed as result of shifting between any higher gear and a lower gear. Further, the disclosure may also be applicable to operations in which the machine is traveling autonomously forwards in addition to reverse.

INDUSTRIAL APPLICABILITY

The industrial applicability of the planning system 45 described herein will be readily appreciated from the forgoing discussion. The foregoing discussion is applicable to systems in which one or more machines 10 are operated autonomously or semi-autonomously at a work site 100 to perform slot dozing operations. Such system may be used at a mining site, a landfill, a quarry, a construction site, a roadwork site, a forest, a farm, or any other area in which movement of material is desired.

Figure 6:
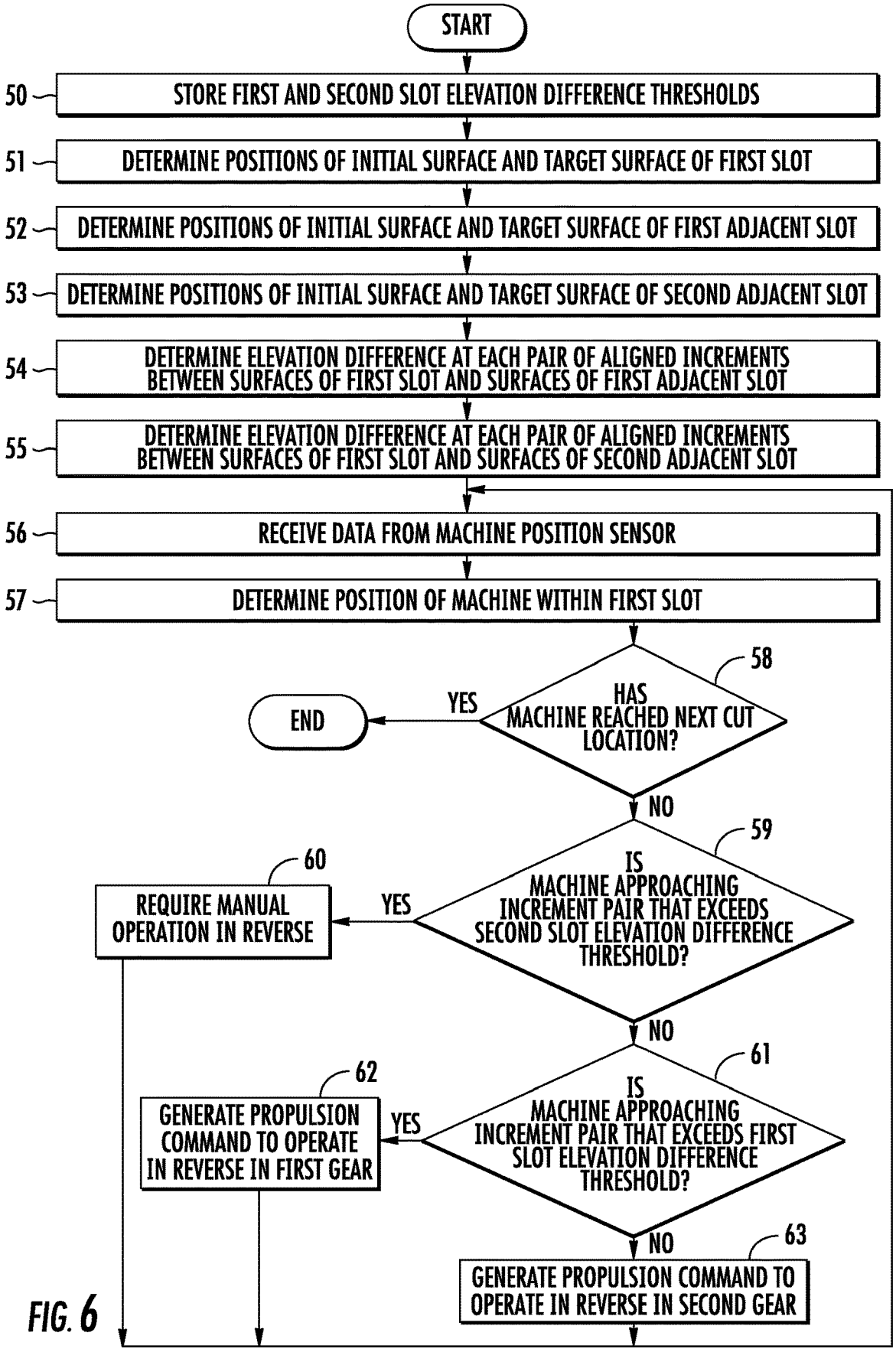
FIG. 6 depicts a flowchart illustrating the reversing control process in accordance with the disclosure.

The flowchart of FIG. 6 depicts a portion of a slot dozing process in which the planning system 45 is operative to control the manner in which the machine 10 is operated in reverse in a slot 110, such as when reversing from the dump location 108. For purposes of this description, the slot 110 for which the planning system 45 is controlling the reversing operation is referred to as the "first" slot and the slots on opposite sides of the first slot are referred to as the first adjacent slot and the second adjacent slot, respectively. The planning system 45 may also be operative to control the reversing operation of other machines that are located within the first and second adjacent slots by repeating the process described herein with respect to each of those slots.

At stage 50, the first and second slot elevation difference thresholds and may be set or stored within the controller 36. In one example, the first slot elevation difference threshold may be equal to one half the height of the machine 10 or approximately 2.5 m and the second slot elevation difference threshold may be equal to the height of the machine or approximately 5 m.

The elevations of the initial surface and the target surface for the first slot 110 may be determined or accessed at stage 51. The elevation of the initial surface may be stored within the controller 36, either onboard the machine 10 or at a location remote from the machine. The elevation of the initial surface may be determined in any desired manner. In one embodiment, the elevation of the initial surface may be determined based upon the machine elevation sensing system 27. For example, the controller 36 may determine the elevation of the work surface upon which the machine 10 is traveling based upon the elevation of the machine position sensor 28 and the dimensions of the machine. The position of the target surface may be determined by the planning system 45 of the control system 35 prior to beginning a material moving process associated with a new layer 113. In one example, the thickness or height of the layer 113 may be approximately 1 m.

At stage 52, the elevations of the initial surface and the target surface for the first adjacent slot or on one side of the first slot may be determined or accessed. The elevations of the initial surface and the target surface may be determined and stored within a controller 36 on-board a machine 10 operating within the first adjacent slot or at a location remote from the machine operating within the first adjacent slot. The elevations of the initial surface and the target surface for the second adjacent slot may be determined or accessed at stage 53 in a manner similar to that described above with respect to stages 51-52.

If desired, rather than determining and storing the elevations of the entire initial surface and the target surface for the first slot 110, the elevations of the increments 109 that are spaced apart along the initial surface and the target may be stored within the controller 36. Similarly, elevations of increments 109 of the initial surface and the target surface for each of the first adjacent slot and the second adjacent slot may be stored within the controller 36. The increments 109 associated with the first slot 110 are laterally aligned with those increments associated with the first adjacent slot and the second adjacent slot. In other words, for each increment 109 of the first slot 110 has a laterally aligned increment on each of the first adjacent slot and the second adjacent slot. Each increment 109 associated with the first slot 110 and its laterally aligned increment of the first adjacent slot defines a pair of first laterally aligned positions and each increment 109 associated with the first slot 110 and its laterally aligned increment of the second adjacent slot defines a pair of second laterally aligned positions.

The elevation difference between the surfaces of the first slot and the surfaces of the first adjacent slot are compared at stage 54. In doing so, the controller 36 may compare each increment of the initial surface of the first slot to the laterally aligned increments of both the initial surface and the target surface of the first adjacent slot. The controller 36 may then compare each increment of the target surface of the first slot to the laterally aligned increments of both the initial surface and the target surface of the first adjacent slot. At stage 55, the elevation difference between the surfaces of the first slot and the surfaces of the second adjacent slot are compared at stage 54. In doing so, the controller 36 may compare each increment of the initial surface of the first slot to the laterally aligned increments of both the initial surface and the target surface of the second adjacent slot. The controller 36 may then compare each increment of the target surface of the first slot to the laterally aligned increments of both the initial surface and the target surface of the second adjacent slot.

With such a process, the controller 36 may determine the maximum potential difference between any of the surfaces (i.e., initial surface, target surface, or actual surface) and any of the surfaces of both the first and second adjacent slots. By operating the planning system 45 based upon the maximum potential difference between the first slot and the slots on opposite sides thereof, the machine 10 may be operated along the first slot in the most conservative manner.

Further, the controller 36 may communicate the maximum potential differences between the surfaces to an operator responsible for monitoring the operation of the machines 10 or to the planning system 45. The operator may be at a location adjacent the machines 10 or at a remote location. In one embodiment, the controller may generate a visual display to assist in identifying to the operator that the maximum potential differences between the surfaces is approaching or has exceeded one or more of the slot elevation difference thresholds. For example, colors associated with the slots may be indicated on a display based elevation differences between adjacent slots. In some embodiments, it may be desirable for the operator to modify an aspect of the control system 35 to modify the routing of the machines 10 at the work site 100 to reduce the elevation differences between slots 110.

The controller 36 may receive at stage 56 machine position signals or data from the machine position sensor 28. At stage 57, the controller 36 may determine the position of the machine 10 along the slot 110 based upon the machine position signals from the machine position sensor 28.

As the machine 10 continues to be moved in reverse, the controller 36 may determine at decision stage 58 whether the machine 10 has reached its next desired cut location. If the machine 10 has reached its next desired cut location, the process of the flowchart of FIG. 6 for controlling the reversing operation may be terminated and the next cutting operation by the machine 10 begun.

If the machine 10 has not reached its next desired cut location, the controller 36 may determine at decision stage 59 whether the machine 10 is approaching an increment pair that exceeds the second slot elevation difference threshold. In doing so, based upon the position of the machine 10, the controller 36 may identify those increment pairs that are within a threshold distance of the machine. If the machine 10 is within the threshold distance of an increment pair that exceeds the second slot elevation difference threshold, the controller 36 may at stage 60 require manual operation of the machine as it is operated in reverse. In doing so, the controller 36 may terminate autonomous or semi-autonomous reverse propulsion of the machine 10 and communicate to a remote operator that the autonomous or semi-autonomous propulsion has been terminated and further propulsion in reverse must be performed manually. The process may then be continued by returning to stage 56.

If the machine 10 is not approaching an increment pair that exceeds the second slot elevation difference threshold at decision stage 59, the controller 36 may determine at decision stage 61 whether the machine 10 is approaching an increment pair that exceeds the first slot elevation difference threshold. In doing so, based upon the position of the machine 10, the controller 36 may identify those increment pairs that are within a threshold distance of the machine. If the machine 10 is within the threshold distance of an increment pair that exceeds the first slot elevation difference threshold, the controller 36 may at stage 61 generate a propulsion command to operate the machine in reverse in first gear. The process may then be continued by returning to stage 56.

If the machine 10 is not approaching an increment pair that exceeds the first slot elevation difference threshold at decision stage 61, the controller 36 may generate a propulsion command to operate the machine in reverse in second gear. The process may then be continued by returning to stage 56.

It will be appreciated that the foregoing description provides examples of the disclosed system and technique. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

The invention claimed is:

1. A system for automated control of a machine along a first slot in a work surface, the first slot being adjacent to a second slot in the work surface with a berm disposed between the first slot and the second slot, the system comprising:

a machine position sensor for generating a plurality of machine position signals indicative of a position of the machine at a work site; and a controller configured to:

store a slot elevation difference threshold;

receive a plurality of machine position signals from the machine position sensor;

determine the position of the machine along the first slot based upon the plurality of machine position signals;

access a plurality of first positions of at least one first slot surface spaced apart along the first slot;

access a plurality of second positions of at least one second slot surface along the second slot, each of the plurality of first positions being laterally aligned with one of the plurality of second positions to define pairs of laterally aligned positions;

determine an elevation difference between each pair of laterally aligned positions;

generate a first propulsion command to operate the machine according to a first propulsion mode while the machine is disposed along the first slot adjacent each pair of laterally aligned positions at which the elevation difference is less than the slot elevation difference threshold; and generate a second propulsion command to operate the machine according to a second propulsion mode while the machine is disposed along the first slot adjacent each pair of laterally aligned positions at which the elevation difference is greater than the slot elevation difference threshold.

2. The system of claim 1, wherein the at least one first slot surface corresponds to one of an initial surface of the first slot and a target surface of the first slot.

3. The system of claim 2, wherein the at least one first slot surface further corresponds to another of the initial surface of the first slot and the target surface of the first slot.

4. The system of claim 2, wherein the controller is further configured to:

access a plurality of third positions of a third surface along the first slot, the third surface corresponding to another of the initial surface of the first slot and the target surface of the first slot, and each of the plurality of third positions being laterally aligned with one of the plurality of second positions to define second pairs of laterally aligned positions;

determine a second elevation difference between each second pair of laterally aligned positions;

generate the first propulsion command to operate the machine according to the first propulsion mode while the machine is disposed along the first slot adjacent each second pair of laterally aligned positions at which the second elevation difference is less than the slot elevation difference threshold; and generate the second propulsion command to operate the machine according to the second propulsion mode while the machine is disposed along the first slot adjacent each second pair of laterally aligned positions at which the second elevation difference is greater than the slot elevation difference threshold.

5. The system of claim 1, further comprising a work surface elevation sensor for generating a plurality of elevation signals indicative of an elevation of the work surface, and the controller is further configured to determine elevations of the plurality of first positions of the at least one first slot surface along the first slot based upon the plurality of elevation signals.

6. The system of claim 1, wherein the at least one second slot surface corresponds to one of an initial surface of the second slot and a target surface of the second slot.

7. The system of claim 6, wherein the controller is further configured to:

access a plurality of third positions of a third surface along the second slot in the work site, the third surface corresponding to another of the initial surface of the second slot and the target surface of the second slot, and each of the plurality of first positions being laterally aligned with one of the plurality of third positions to define second pairs of laterally aligned positions;

determine a second elevation difference between each second pair of laterally aligned positions;

generate the first propulsion command to operate the machine according to the first propulsion mode while the machine is disposed along the first slot adjacent each second pair of laterally aligned positions at which the second elevation difference is less than the slot elevation difference threshold; and generate the second propulsion command to operate the machine according to the second propulsion mode while the machine is disposed along the first slot adjacent each second pair of laterally aligned positions at which the second elevation difference is greater than the slot elevation difference threshold.

8. The system of claim 6, wherein the slot elevation difference threshold is a first slot elevation difference threshold, and the controller is further configured to:

store a second slot elevation difference threshold, the second slot elevation difference threshold being greater than the first slot elevation difference threshold; and generate a third propulsion command to operate the machine according to a third propulsion mode while the machine is disposed along the first slot adjacent each pair of laterally aligned positions at which the elevation difference is greater than the second slot elevation difference threshold.

9. The system of claim 1, further comprising a work surface elevation sensor for generating a plurality of elevation signals indicative of an elevation of the work surface, and the controller is further configured to determine elevations of the plurality of second positions of the at least one second slot surface along the second slot based upon the plurality of elevation signals.

10. The system of claim 1, wherein the slot elevation difference threshold is a first slot elevation difference threshold, and the controller is further configured to:

store a second slot elevation difference threshold, the second slot elevation difference threshold being greater than the first slot elevation difference threshold; and generate a third propulsion command to operate the machine according to a third propulsion mode while the machine is disposed along the first slot adjacent each pair of laterally aligned positions at which the elevation difference is greater than the second slot elevation difference threshold.

11. The system of claim 1, wherein the slot elevation difference threshold is a first slot elevation difference threshold and the at least one second slot surface corresponds to one of an initial surface of the second slot and a target surface of the second slot, and the controller is further configured to:

store a second slot elevation difference threshold;

generate a third propulsion command to operate the machine according to a third propulsion mode while the machine is disposed along the first slot adjacent each pair of laterally aligned positions at which the elevation difference is greater than the second slot elevation difference threshold;

access a plurality of third positions of a third surface along the second slot, the third surface corresponding to another of the initial surface of the second slot and the target surface of the second slot, and each of the plurality of first positions being laterally aligned with one of the third plurality of positions to define second pairs of laterally aligned positions;

determine a second elevation difference between each second pair of laterally aligned positions;

generate the first propulsion command to operate the machine according to the first propulsion mode while the machine is disposed along the first slot adjacent each second pair of laterally aligned positions at which the second elevation difference is less than the first slot elevation difference threshold;

generate the second propulsion command to operate the machine according to the second propulsion mode while the machine is disposed along the first slot adjacent each second pair of laterally aligned positions at which the second elevation difference is greater than the first slot elevation difference threshold and less than the second slot elevation difference threshold; and generate the third propulsion command while the machine is disposed along the first slot adjacent each second pair of laterally aligned positions at which the second elevation difference is greater than the second slot elevation difference threshold.

12. A controller-implemented method for automated control of a machine along a first slot in a work surface, the first slot being adjacent to a second slot in the work surface with a berm disposed between the first slot and the second slot, the method comprising:

storing a slot elevation difference threshold;

receiving a plurality of machine position signals from a machine position sensor;

determining a position of the machine along the first slot based upon the plurality of machine position signals;

accessing a plurality of first positions of at least one first slot surface spaced apart along the first slot;

accessing a plurality of second positions of at least one second slot surface along the second slot, and each of the plurality of first positions being laterally aligned with one of the plurality of second positions to define pairs of laterally aligned positions;

determining an elevation difference between each pair of laterally aligned positions;

generating a first propulsion command to operate the machine according to a first propulsion mode while the machine is disposed along the first slot adjacent each pair of laterally aligned positions at which the elevation difference is less than the slot elevation difference threshold; and generating a second propulsion command to operate the machine according to a second propulsion mode while the machine is disposed along the first slot adjacent each pair of laterally aligned positions at which the elevation difference is greater than the slot elevation difference threshold.

13. The controller-implemented method of claim 12, wherein the at least one first slot surface corresponds to one of an initial surface of the first slot and a target surface of the first slot.

14. The controller-implemented method of claim 13, wherein the at least one first slot surface further corresponds to another of the initial surface of the first slot and the target surface of the first slot.

15. The controller-implemented method of claim 13, further comprising:

accessing a plurality of third positions of a third surface along the first slot, the third surface corresponding to another of the initial surface of the first slot and the target surface of the first slot, and each of the plurality of third positions being laterally aligned with one of the plurality of second positions to define second pairs of laterally aligned positions;

determining a second elevation difference between each second pair of laterally aligned positions;

generating the first propulsion command to operate the machine according to the first propulsion mode while the machine is disposed along the first slot adjacent each second pair of laterally aligned positions at which the second elevation difference is less than the slot elevation difference threshold; and generating the second propulsion command to operate the machine according to the second propulsion mode while the machine is disposed along the first slot adjacent each second pair of laterally aligned positions at which the second elevation difference is greater than the slot elevation difference threshold.

16. The controller-implemented method of claim 12, further comprising determining elevations of the plurality of first positions of the at least one first slot surface along the first slot based upon a plurality of elevation signals from a work surface elevation sensor.

17. The controller-implemented method of claim 12, further comprising determining elevations of the plurality of second positions of the at least one second slot surface along the second slot based upon a plurality of elevation signals from a work surface elevation sensor.

18. The controller-implemented method of claim 12, wherein the slot elevation difference threshold is a first slot elevation difference threshold, and further comprising:

storing a second slot elevation difference threshold, the second slot elevation difference threshold being greater than the first slot elevation difference threshold; and generating a third propulsion command to operate the machine according to a third propulsion mode while the machine is disposed along the first slot adjacent each pair of laterally aligned positions at which the elevation difference is greater than the second slot elevation difference threshold.

19. The controller-implemented method of claim 12, wherein the slot elevation difference threshold is a first slot elevation difference threshold and the at least one second slot surface corresponds to one of an initial surface of the second slot and a target surface of the second slot, and further comprising:

storing a second slot elevation difference threshold;

generating a third propulsion command to operate the machine according to a third propulsion mode while the machine is disposed along the first slot adjacent each pair of laterally aligned positions at which the elevation difference is greater than the second slot elevation difference threshold;

accessing a plurality of third positions of a third surface along the second slot, the third surface corresponding to another of the initial surface of the second slot and the target surface of the second slot, and each of the plurality of first positions being laterally aligned with one of the third plurality of positions to define second pairs of laterally aligned positions;

determining a second elevation difference between each second pair of laterally aligned positions;

generating the first propulsion command to operate the machine according to the first propulsion mode while the machine is disposed along the first slot adjacent each second pair of laterally aligned positions at which the second elevation difference is less than the slot elevation difference threshold;

generating the second propulsion command to operate the machine according to the second propulsion mode while the machine is disposed along the first slot adjacent each second pair of laterally aligned positions at which the second elevation difference is greater than the slot elevation difference threshold and less than the second slot elevation difference threshold; and generating the third propulsion command while the machine is disposed along the first slot adjacent each second pair of laterally aligned positions at which the second elevation difference is greater than the second slot elevation difference threshold.

20. A machine, comprising:

a prime mover;

a ground-engaging work implement for engaging a work surface along a path;

a machine position sensor for generating a plurality of machine position signals indicative of a position of the machine at a work site; and a controller configured to:

store a slot elevation difference threshold;

receive a plurality of machine position signals from the machine position sensor;

determine the position of the machine along a first slot in a work surface based upon the plurality of machine position signals;

access a plurality of first positions of at least one first slot surface spaced apart along the first slot;

access a plurality of second positions of at least one second slot surface along a second slot in the work surface, the first slot being adjacent to the second slot with a berm disposed between the first slot and the second slot, and each of the plurality of first positions being laterally aligned with one of the plurality of second positions to define pairs of laterally aligned positions;

determine an elevation difference between each pair of laterally aligned positions;

generate a first propulsion command to operate the machine according to a first propulsion mode while the machine is disposed along the first slot adjacent each pair of laterally aligned positions at which the elevation difference is less than the slot elevation difference threshold; and generate a second propulsion command to operate the machine according to a second propulsion mode while the machine is disposed along the first slot adjacent each pair of laterally aligned positions at which the elevation difference is greater than the slot elevation difference threshold.

* * * * *